United States Patent [19]

Lankry

[11] Patent Number: 5,048,237

[45] Date of Patent: Sep. 17, 1991

[54] ATTACHMENT FOR A POWER TOOL

[76] Inventor: Julien J. L. Lankry, Hillcrest, Brookdale Road, Gatley, Cheadle, Cheshire, SK7 2NW, England

[21] Appl. No.: 516,124

[22] Filed: Apr. 27, 1990

[30] Foreign Application Priority Data

Nov. 28, 1989 [GB] United Kingdom ..... 8926883

[51] Int. Cl.[5] ..... B24B 45/00

[52] U.S. Cl. ..... 51/168; 464/87; 464/106; 15/144 R

[58] Field of Search ..... 51/168, 209 R, 358, 51/170 T, 367, 378; 15/144 R, 144 A; 464/58, 87, 89, 106, 182

[56] References Cited

U.S. PATENT DOCUMENTS 2,371,021 3/1945 Berry ..... 51/168

4,674,234 6/1987 Reiling et al. ..... 51/168

4,890,422 1/1990 Reiling et al. ..... 51/168

FOREIGN PATENT DOCUMENTS 3222858 5/1983 Fed. Rep. of Germany ..... 51/358

*Primary Examiner*—Roscoe V. Parker

*Attorney, Agent, or Firm*—Pearson & Pearson

[57] ABSTRACT

An attachment for a power tool (10) has a drive shaft (32) for driving connection to the tool (10) and a rotatable disc (12) linked transversely thereto. The link between the disc (12) and shaft (32) is formed by a flexible membrane (16) which permits relative angular movement between the disc (12) and shaft (32). A locking arrangement (34, 36) is also disclosed which enables the disc (12) to be selectively held substantially rigidly with respect to the shaft (32) if desired.

9 Claims, 1 Drawing Sheet

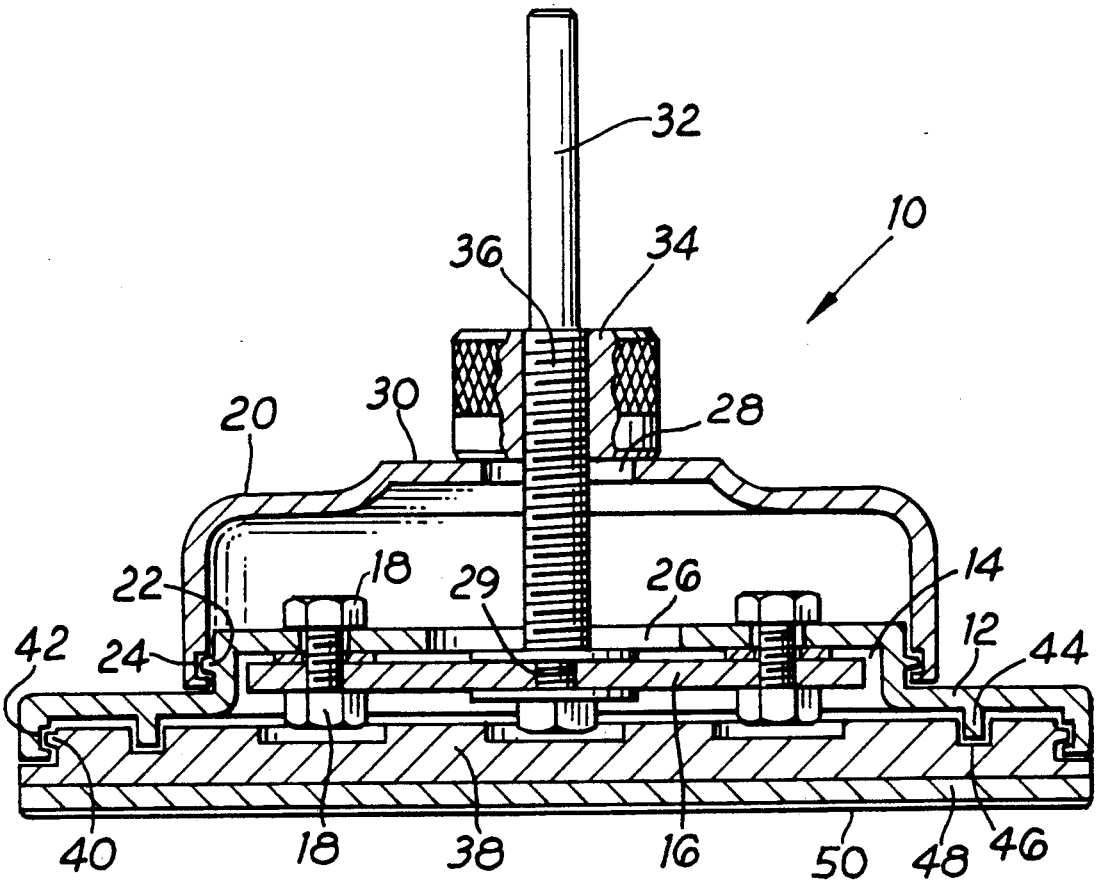
32
10
36
34
30
28
20
22
18
29
26
14
42
24
12
44
40
18
38
16
50
48
46

ATTACHMENT FOR A POWER TOOL

This invention relates to apparatus which may be fitted to tools in order that various operations may be performed on a desired object and in particular to a sanding or buffering attachment which may be fitted to a power tool.

In known apparatus for this purpose a sanding or buffering surface is mounted on a disc, the disc being mounted on a shaft via a flexible block or universal joint.

However with these known arrangements problems arise in that the attachments tend to be complicated and expensive to construct and the amount of transverse flexibility and the reproducibility thereof, relative to the shaft is minimal.

Copending United Kingdom Patent Application No. 8822437.3 provides one solution to these problems. The present invention seeks to provide an alternative solution.

According to the present invention there is provided a sanding or like attachment for a power tool, the said attachment comprising a drive shaft, a disc extending transversely to the drive shaft, said disc being adapted to receive at least one of an abrasive or buffering element and said drive shaft being laterally angularly movable relative to the disc, and locking means selectively operable to hold the disc substantially rigidly with respect to the drive shaft, characterised by flexible membrane means intermediate and linking the disc and drive shaft and susceptible to the action of the locking means in controlling relative lateral angular movement therebetween.

Preferably the disc has a central orifice over which the flexible membrane extends and said shaft may be attached at one end thereof to said flexible membrane.

A housing may extend from the disc in the axial direction of the shaft, the top of the housing having a central aperture through which the shaft extends with clearance therebetween.

Said locking means may comprise a nut which is adapted to bear against the disc or the top of the housing, the nut preferably being in threaded engagement with the shaft. Alternatively other forms of locking means may be used as appropriate or as desired.

The shaft is preferably withdrawn relative to the abrasive or buffering element under operation of said locking means into the said rigid position.

The flexible membrane preferably comprises a flexible plastics material.

In order that the invention may be more readily understood, a specific embodiment thereof will now be described by way of example only, with reference to the single FIGURE of the accompanying drawing illustrating the same.

Referring to the drawing, an attachment for a power tool 10 comprises a disc 12 of stepped configuration comprising a recess 14 in which a flexible plastics sheet 16 is received. The flexible plastics sheet 16 is connected to the disc 12 via nuts and bolts 18. A rigid plastics housing 20 snap fits onto the reverse side of the recess 14 by engagement between rib 22 and channel 24.

A central orifice 26 is provided in the recessed part of the disc 13 and a central aperture 28 is provided in the top 30 of housing 20. The orifice 26 and aperture 28 are co-axial.

A threaded drive shaft 32 extends through orifice 26 and aperture 28, one end 29 of the drive shaft 32 being connected to the flexible plastics sheet 16.

A nut 34 rests on top of housing 20 and engages the thread 36 on the drive shaft, such that rotation of nut 34 will move the shaft 32 vertically.

A circular plastics plate 38 is attached to the disc 12 via a snap-fit between rib 40 and groove 42. Location pins 44 extend from the underside of disc for engagement with location holes 46 in plate 38. A self-adhesive annular foam rubber pad 48 is attached to the underside of circular plate 38. Attached to the outer face of the pad 48 is a pad 50 of Velcro (Registered Trade Mark) material which is of like diameter to pad 48 and by which a sanding or buffering surface can be removably attached to the disc.

In use, flat engagement with a workpiece can be ensured throughout a wide range of positions of the shaft 32 relative to disc 12 by ensuring that the nut 34 is rotated away from the top 30 of housing 20 thus allowing the plastics sheet 16 to be flexed by movement of shaft 32.

Alternatively, if it is desired that the disc 12 be securely located in a set position, the nut 34 is rotated towards the top of the housing 30. This causes the shaft to move axially thereby withdrawing the plastics sheet 16 to its limit of flexibility, thus ensuring a rigid connection.

In this way it is possible, for example in an application to a sanding machine, for efficient coarse or fine sanding to be achieved depending on the rigidity or flexibility of the attachment which can be determined by the position of nut 34 as described above.

It is, of course, to be understood that the invention is not intended to be restricted to the details of the above embodiment which are described by way of example only.

I claim:

1. An attachment for a power tool comprising a drive shaft, a disc extending transversely to the drive shaft, said disc being adapted to receive at least one of an abrasive or buffering element and said drive shaft being laterally angularly movable relative to the disc, and locking means selectively operable to hold the disc substantially rigidly with respect to the drive shaft, characterised by flexible membrane means intermediate and linking the disc and drive shaft and susceptible to the action of the locking means in controlling relative lateral angular movement therebetween, said locking means being operable to move said shaft to a position withdrawn relative to the abrasive or buffering element, in such position the shaft and disc being held rigidly with respect to each other.

2. An attachment according to claim 1, wherein said disc has a central orifice over which said flexible membrane extends.

3. An attachment according to claim 1, wherein said shaft is attached at one end thereof to said flexible membrane.

4. An attachment according to claim 1, wherein said disc has a central orifice over which said flexible membrane extends and said shaft is attached at one end thereof to said flexible membrane.

5. An attachment according to claim 1, further comprising a housing which extends from the disc in the axial direction of the shaft, the top of the housing having a central aperture through which the shaft extends with clearance therebetween.

6. An attachment according to claim 1, wherein said disc has a central orifice over which said flexible membrane extends and further comprising a housing which extends from the disc in the axial direction of the shaft, the top of the housing having a central aperture through which the shaft extends with clearance therebetween.

7. An attachment according to claim 5, wherein said locking means comprises a nut which is adapted to be against a top surface of the housing.

8. An attachment according to claim 7, whrein said nut is in threaded engagement with the shaft.

9. An attachment according to claim 1, wherein said flexible membrane comprises a flexible plastics material.

* * * * *